US006209266B1

(12) United States Patent
Branc et al.

(10) Patent No.: US 6,209,266 B1
(45) Date of Patent: Apr. 3, 2001

(54) WORKSPACE DISPLAY

(75) Inventors: Joseph R. Branc, Grand Rapids; Mark A. Baloga, East Grand Rapids; William L. Miller, Ada; Mitchell Niewiadomski, Lowell; Joel D. Stanfield, Grand Rapids, all of MI (US)

(73) Assignee: Steelcase Development Inc., Grand Rapids, MI (US)

( * ) Notice: Subject to any disclaimer, the term of this patent is extended or adjusted under 35 U.S.C. 154(b) by 0 days.

(21) Appl. No.: 09/438,591

(22) Filed: Nov. 12, 1999

Related U.S. Application Data

(62) Division of application No. 08/816,487, filed on Mar. 13, 1997, now Pat. No. 6,122,865.

(51) Int. Cl.[7] ..... E04B 2/74
(52) U.S. Cl. ..... 52/36.1; 52/239
(58) Field of Search ..... 52/27, 36.1, 239; 359/443, 460

(56) References Cited

U.S. PATENT DOCUMENTS 1,189,779 * 7/1916 Erickson ..... 52/6
5,765,315 * 6/1998 Nagamitsu et al. ..... 52/36.1

OTHER PUBLICATIONS

ACM 1992 Conference on Computer–Supported Cooperative Work (CSCW '92) Proceedings, "Sharing Perspective", Toronto, Canada; sponsored by ACM Sigchi & Sigois, 1992.*

* cited by examiner

*Primary Examiner*—Carl D. Friedman
*Assistant Examiner*—Kevin D. Wilkens
(74) *Attorney, Agent, or Firm*—Price, Heneveld, Cooper, DeWitt & Litton

(57) ABSTRACT

A workspace display comprises a sidewall partition defining a workspace with a portal opening and a door partition to selectively close the portal. A first display screen is disposed on the interior side of the door partition for individual viewing from inside the workspace. A second display screen is disposed exterior of the sidewall partition and positioned a spaced apart distance in general alignment therewith, without substantial interference with user ingress and egress through the portal opening. A video device is positioned overhead in optical communication with the first display screen when the door partition is in its fully closed position to support individual activities. The video device is in optical communication through the portal opening with the second display screen when the door partition is in its fully open position to support group activities. An image on the second display screen can be viewed on either the interior or exterior screen surfaces. The first display screen and the interior and exterior screen surfaces of the second display screen form dry erasable markerboards.

18 Claims, 11 Drawing Sheets

WORKSPACE DISPLAY

CROSS-REFERENCES TO RELATED APPLICATIONS

The present application is a divisional of U.S. application Ser. No. 08/816,487, filed Mar. 13, 1997, now U.S. Pat. No. 6,122,865. The present application is also related to issued U.S. Pat. No. 5,794,392, entitled UTILITY DISTRIBUTION SYSTEM, as well as issued U.S. Pat. No. 5,768,840 entitled NON-STRUCTURAL PANEL FOR RAISED FLOOR, and issued U.S. Pat. No. 5,282,341, entitled DYNAMIC WORKSPACE MODULE, all of which are hereby incorporated by reference.

BACKGROUND OF THE INVENTION

The present invention relates to office furnishings and the like, and in particular to a workspace display.

Open office plans are well known in the art, and generally comprise large, open floor spaces in buildings that are furnished in a manner that is readily reconfigurable to accommodate the ever changing needs of a specific user, as well as the diverse requirements of different tenants. One arrangement commonly used for furnishing open plans includes moveable partition panels that are detachably interconnected to partition off the open spaces into individual workstations and/or offices, and are generally known in the office furniture industry as "systems furniture". Another arrangement for dividing and/or partitioning open plans utilizes workspace modules which have a free-standing framework supporting a three-sided partition arrangement to form an interior workspace, and a portal opening for user ingress and egress. A workspace module includes a door partition that is shaped to selectively close the portal opening, and is movably mounted on the framework. The door partition is positioned adjacent one side of the portal opening, such that shifting the door partition from the fully open position to the fully closed position increases the amount of interior space in the workspace to provide both improved freedom of user movement, and a sense of roominess and comfort.

Group problem-solving techniques necessarily involve some degree of interaction between co-workers and interaction with the information of their work, thereby creating the need in furnishings and communications equipment in modern office environments to promote both increased group communications, and also support individual problem-solving. Many types of highly trained "knowledge workers", such as engineers, accountants, computer programmers, and the like, are now being supported in open office settings, instead of conventional private offices, in order to gain increased efficiency of real estate and life cycle costs. Throughout a given work day, an office worker normally oscillates between interaction with others and time spent alone. In addition, the increasing use of computers and electrical communications devices has changed the way in which workers interact with other workers and perform their tasks.

Workspace modules or individual workstations made from partition panel systems may be positioned around an open, group or common workspace to support both individual and group work activities. This arrangement facilitates combined group and individual work activities, while simultaneously maximizing the utilization of floor space. Both the "systems furniture" and the workspace module office arrangements commonly include provisions for computers and conventional telephone communications equipment.

Displays, such as, dry erasable markerboards and/or projectors are also important to support group worker activities. Since knowledge workers typically constitute a major portion of group problem-solving teams, it is important to provide such highly skilled workers with computational and communications devices that promote efficient group and individual work activities. Therefore, there is a need for a projection display system that utilizes vertical surfaces and combines various display functions on a large, easy to view screen that can be integrated into a furniture system, designed to facilitate group and individual tasks while simultaneously maximizing the utilization of existing floorspace.

Various surfaces having a dry erasable surface are known in the art. These surfaces are commonly known as "dry wipe," "whiteboard," or "dry erasable" to refer to a surface that can be marked with dry erasable marker ink, and wiped off from the surface with a dry cloth or eraser. These dry erasable markerboards generally have a high gloss, white surface. Although the high gloss surface facilitates erasability, it is generally not suitable for a projection display screen since the high gloss surface creates an image that may be difficult to view.

One approach, described in U.S. Pat. No. 5,361,164, has been to cover a white, opaque layer with a transparent dry erasable layer on which a bi-directional lenticular surface is embossed. Although this produces a surface that can be used as a dry erasable markerboard and also as a projection display screen, the resulting surface provides a relatively low gain, requiring a higher powered projector to produce an image having sufficient brightness.

Rear projection display screens are commonly used in commercially available televisions and in business conference meeting rooms. However, since the rear, or projection side, of the screen is closed off by the housing of the television, two-sided viewing is not generally possible. These screens may have a surface that is suitable for use as a dry erasable markerboard.

Currently available rear projection display screens normally have a relatively large housing in which the projector is mounted. In addition to limiting the display screen to one-sided viewing, the housing requires substantial floorspace, particularly with the larger display screens. Smaller, desktop CRT computer monitors require desktop space, are sized for individual viewing, and are generally limited to the single function of displaying computer-generated images. Therefore, there was a need for a display screen which utilized vertical surfaces such that the use of floor and desk space is minimized. In addition, it would also be desirable to have a display screen having multi-functional capability for both individual and group activities, including the display of electronically generated images, or handwritten information to thereby eliminate the need for multiple devices to perform these functions.

SUMMARY OF THE INVENTION

One aspect of the present invention is a workspace display for open plan spaces and the like including a sidewall partition configured to define a three-sided workspace having a portal opening shaped to permit user ingress and egress therethrough, and a door partition configured to selectively close the portal opening. The door has an interior side, and is movably supported to permit shifting the door partition between a fully open position and a fully closed position for worker privacy. A first display screen is disposed on the interior side of the door partition, and a second display screen is disposed exterior of the sidewall partition, and is positioned a spaced apart distance from the portal opening, in general alignment therewith, while permitting user ingress and egress through the portal opening without substantial interference. A video device is mounted overhead adjacent the sidewall partition, and is in video communication with the first screen when the door partition is in its fully closed position to support individual activities, and with the second screen when the door partition is in its fully open position to support group activities.

Preferably, the video device is a display projector adapted to project images onto the first screen when the door partition is in its fully closed position, and to project images through the portal opening onto the second screen when the door partition is in its fully open position. The second display screen is configured to reflect images inwardly from the display projector to support small group activities, and to transmit images outwardly from the display projector to support large group activities.

Another aspect of the present invention is a workspace display for open plan spaces and the like having a sidewall partition configured to define a three-sided workspace having an interior side, an exterior side, and a portal opening shaped to permit user ingress and egress therethrough. The workspace also has a display opening with two-sided projection display positioned in the display opening, disposed adjacent a comfortable viewing height for an adult user. The projection display has an interior screen facing the interior side of the sidewall partition that reflects projected images inwardly for viewing from the interior side of the sidewall partition. The two-sided projection display also has an exterior screen facing the exterior side of the sidewall partition for transmitting projected images outwardly therethrough for viewing from the exterior side of the sidewall partition. A display projector is mounted overhead adjacent the sidewall partition, and is adapted to project images therefrom onto the interior screen to support individual activities, and to project images therefrom onto the exterior screen to support group activities.

In addition, a door partition that is movably supported to permit shifting between a fully open position for worker interaction and a fully closed position for worker privacy may be included.

Yet another aspect of the present invention is a workspace display having a sidewall partition configured to define a three-sided workspace having an open side that permits user ingress and egress therethrough. A first display screen is disposed on an interior side of the sidewall partition, and a second display screen is disposed exterior of the sidewall partition, and is positioned a spaced apart distance from the open side, in general alignment therewith, allowing user ingress and egress through the open side without substantial interference. A video device is mounted overhead adjacent the sidewall partition, and is in video communication with the first screen to support individual activities, and with the second screen to support group activities.

Preferably, the video device is a display projector adapted to project images onto the first screen when the door partition is in its fully closed position, and to project images through the portal opening onto the second screen when the door partition is in its fully open position. The second display screen has an interior screen surface oriented toward the interior side of the sidewall partition, that is configured to reflect images inwardly from the display projector to support small group activities. The second display screen has an exterior screen surface oriented toward an exterior side of the sidewall partition, and is configured to transmit images outwardly from the display projector to support large group activities.

Yet another aspect of the present invention is a workspace display for open plan spaces and the like having a rear sidewall and a front sidewall spaced apart from the rear sidewall and configured to define a two-sided workspace having an interior and an exterior. The front sidewall has a display opening disposed adjacent a comfortable viewing height for an adult user. A two-sided projection display is positioned in the display opening and generally closes the same. The projection display has an interior screen facing the interior side of the second sidewall partition and reflecting projected images inwardly therefrom for viewing from the interior side of the second sidewall partition. An exterior screen faces the exterior side of the second sidewall partition, and transmits projected images outwardly therethrough for viewing from the exterior side of the second sidewall partition. A display projector is mounted overhead adjacent the workspace, and is adapted to project images therefrom onto the interior screen to support individual activities. The display projector also projects images onto the exterior screen to support group activities.

Yet another aspect of the present invention is a method for displaying images in workstations for open plan spaces and the like, the steps including providing a sidewall partition configured to define a workspace having an open side that permits user ingress and egress therethrough. A first display screen is positioned on an interior side of the sidewall partition. A second display screen is positioned exterior of the sidewall partition at a spaced apart distance from the open side of the sidewall partition, in general alignment therewith, without substantial interference with user ingress and egress through the open side. A display projector is positioned overhead in the sidewall partition. Images are projected from the display projector onto the first display screen to support individual activities. Images are also projected from the display projector through the open side of the sidewall partition onto the second screen to support group activities.

The principal objects of the present invention are to provide a workspace display for open plan spaces and the like that is particularly adapted to effectively and efficiently support knowledge workers engaged in either group work activities or individual work activities. A display screen utilizes a vertical surface for display of images, and requires minimal floorspace. In addition, the display screen has a multi-functional capability, and eliminates the need for a desktop display screen when using a computer. The display screen may have a viewable screen on both surfaces. The display screen can be disposed in the wall of an open plan office system or a workspace module. In addition, the screen may be free-standing adjacent a workspace to facilitate both small-group and large-group activities. The display projector may be operatively connected to either a computer or other audio video equipment. In addition, the display screen may be interfaced with an electronic device that directly translates written material on the markerboard surface into an electronic format in the computer.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
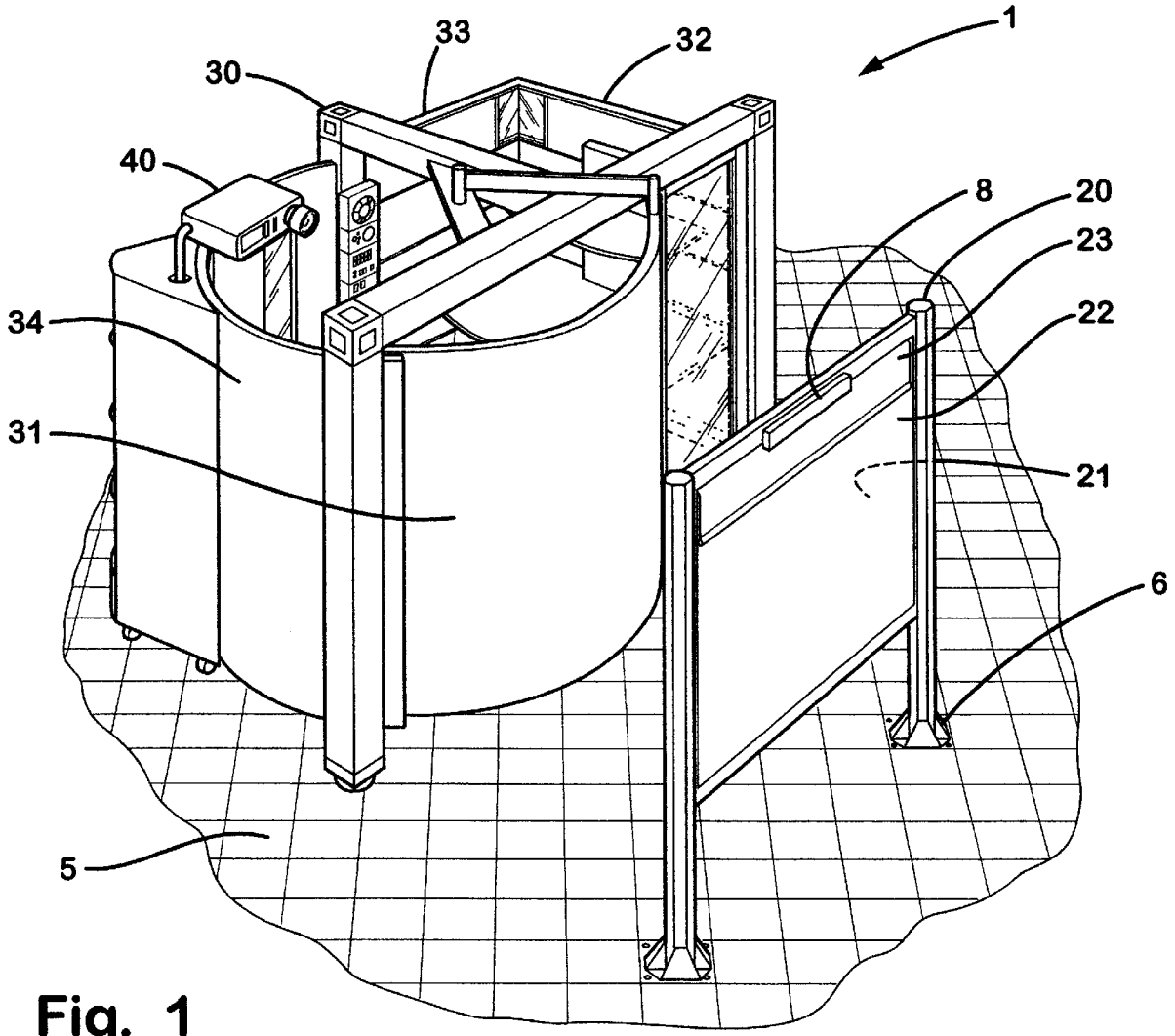
FIG. 1 is a perspective view of a workspace display embodying the present invention, showing a workspace module with a door partition in a fully closed position.

For purposes of description herein, the terms "upper", "lower", "right", "left", "rear", "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
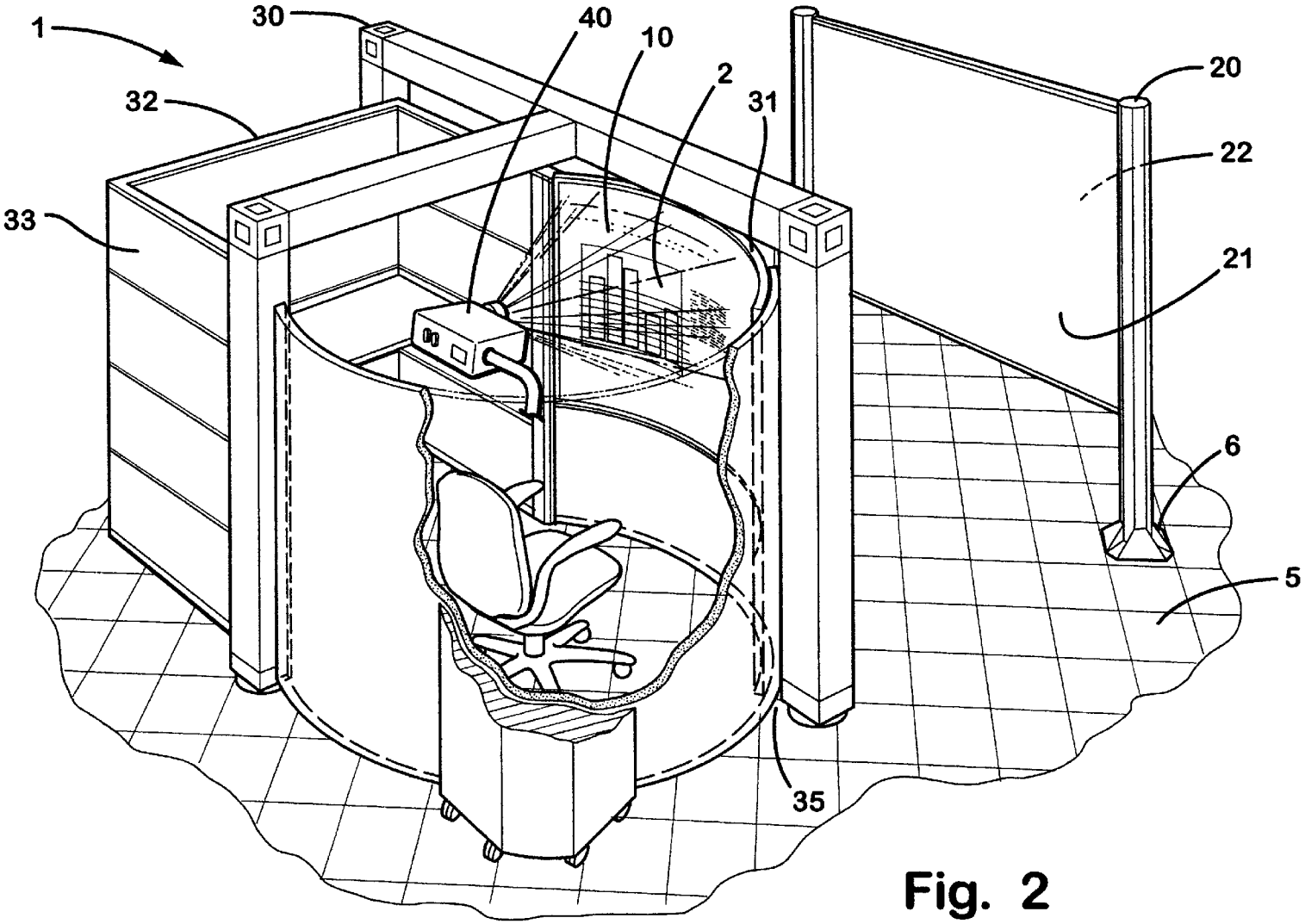
FIG. 2 is a fragmentary, perspective view of the workspace display, showing an image being projected onto a first display screen located on an interior side of the door partition.

The reference number 1 (FIG. 1) generally designates a workspace display for open plan spaces and the like, embodying the present invention. In the illustrated example, a workspace module 30 forms a sidewall partition and has a first display screen 10 located on the inner surface of a door partition 31. A second display screen 20 is disposed exterior of the door partition 31, and is positioned at a spaced apart distance from the door partition 31. The second screen 20 is in general alignment with the portal opening 35, and is located at a sufficient distance to allow user ingress and egress through the portal opening without substantial interference (FIG. 2). The space between the second display screen 20 and the workspace module 30 forms a small group work area for viewing the interior screen surface 21 of the second display screen 20.

Figure 5:
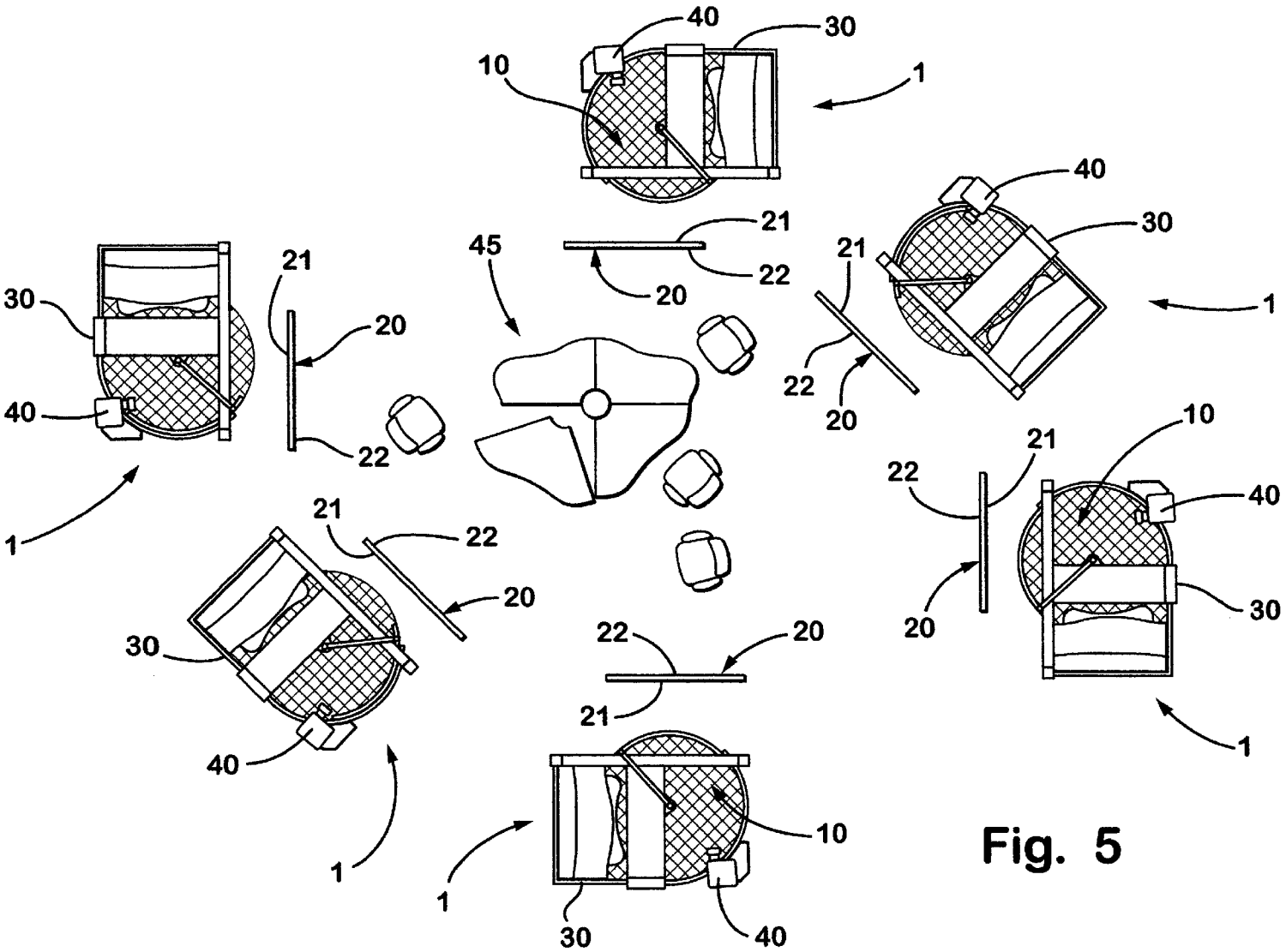
FIG. 5 is a top plan view showing the workspace modules of FIGS. 1–3, with associated display screens positioned around a common or group work area.

As illustrated in FIG. 5, the workspace display 1 may be located adjacent to a group work area 45 to support individual, small group and large group work activities.

Figure 3:
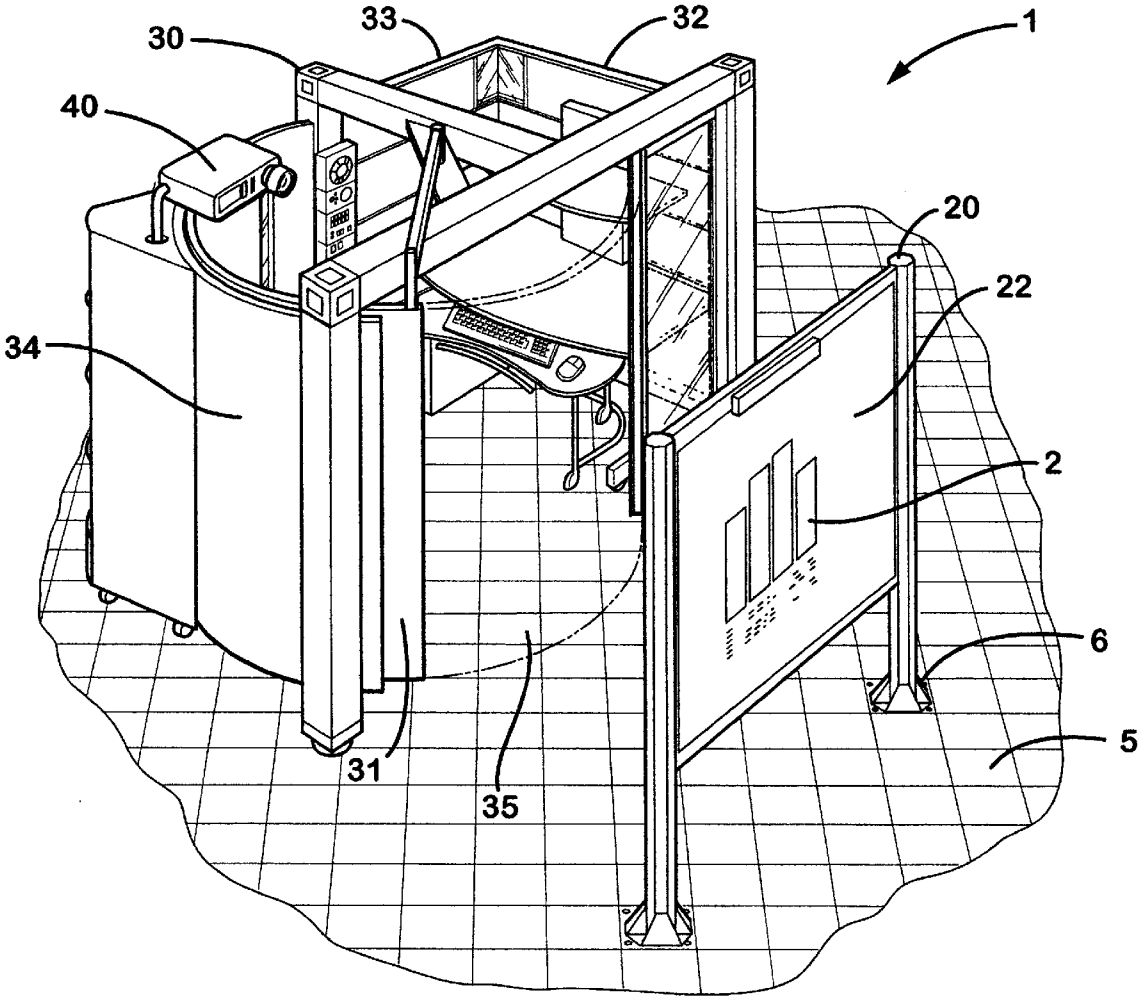
FIG. 3 is a perspective view of the workspace display, showing the door partition in an open position for projection of an image onto the second, exterior display screen.

The workspace module 30 shown in FIGS. 1–3 is substantially similar to the unit disclosed in U.S. Pat. No. 5,282,341, entitled DYNAMIC WORKSPACE MODULE, and has a first side wall partition 32, a second side wall partition 33, and a third side wall partition 34, each of which has interior and exterior sides. A video device such as display projector 40 is mounted to the third side wall partition 34, and is positioned to project an image 2 onto the first display screen 10 when the door partition 31 is in a closed position. The projector 40 can also project an image 2 onto the second display screen 20 when the door partition 31 is in an open position (FIG. 3). Alternatively, the video device could be a camera used to record or transmit images displayed on the display screens. A cover 23 may be utilized to cover the image on the exterior screen surface 22 when privacy is desired for small group work on the interior screen surface 21. The first display screen 10 is a one-sided screen having a low gloss surface forming a combination dry erasable markerboard and projection display surface. The second display screen 20 has an interior screen surface 21 forming a low gloss, erasable markerboard surface for displaying a projected image or use as a markerboard (FIG. 3). The exterior screen surface 22 of the second display screen 20 has a medium gloss, dry erasable marker surface which displays a projected image, and also functions as a markerboard surface (FIG. 2). The term "low gloss" is used to describe a surface having a gloss level of below about 40 percent as measured by a 60 degree gloss meter. The term "medium gloss" describes a surface having a gloss level of about 40–90 percent as measured by a 60 degree gloss meter. Since these terms indicate general ranges, it should be understood that there could be some overlap between the low and medium ranges.

It is anticipated that the first and/or second display screens could have a curved surface if desired for a given application. For example, the first display screen could be arcuate with the user at the center point of the vertical axis such that the image on the screen surface is approximately equidistant from the viewer. The screen could also be curved about a horizontal axis. The display projector 40 is operatively connected to an electronic device such as a computer 3, telecommunications equipment, or video cassette recorder ("VCR") for generating a display image. An electronic input device 8, commonly referred to as an "electronic whiteboard," converts writing on the markerboard interior or exterior surfaces 21 or 22, respectively, to a digital format that can be input to a computer. The resulting digital image may then be printed, faxed, e-mailed, or transmitted in real time to remote locations similar to conventional computer data. A preferred embodiment utilizes a SOFTBOARD electronic whiteboard and associated hardware and software, manufactured by Microfield Graphics, Inc., Beaverton, Oreg.

The workspace display 1 supports either individual work activities, small dyadic group activities, or large group activities. When the door partition 31 is in a closed position, the display screen 10 is used for individual work activities. The large, easily viewed image facilitates individual tasks. When the door partition 31 is in an open position, an image may be projected through the portal opening 35 onto the second display screen 20. If a video camera is used, the image on the second display screen 20 may be recorded or transmitted to a remote location. In addition, a projector and camera may be used simultaneously for projecting and transmitting an image on the display screen. The interior screen surface 21 can be used for small group activities in this configuration. The display projector 40 includes an image-reversing device (not shown) to produce an image that is correctly oriented on the exterior screen surface 22 to support large group activities. Since the display screen has multi-functional capability, redundant equipment, such as a conventional computer monitor, is not required. In addition, the use of vertical surfaces minimizes the amount of floor space required.

With references to FIGS. 1–4, the second display screen 20 may be attached to a prefabricated floor construction 5 with mounting brackets 6 to secure the second display screen 20 at a fixed distance relative to the workspace module 30. The illustrated prefabricated floor construction is similar to that disclosed in U.S. patent application Ser. No. 08/063,463, filed May 18, 1993, entitled UTILITY DISTRIBUTION SYSTEM. Alternatively, the second display screen 20 may be supported by brackets 7 for free-standing applications.

Figure 4:
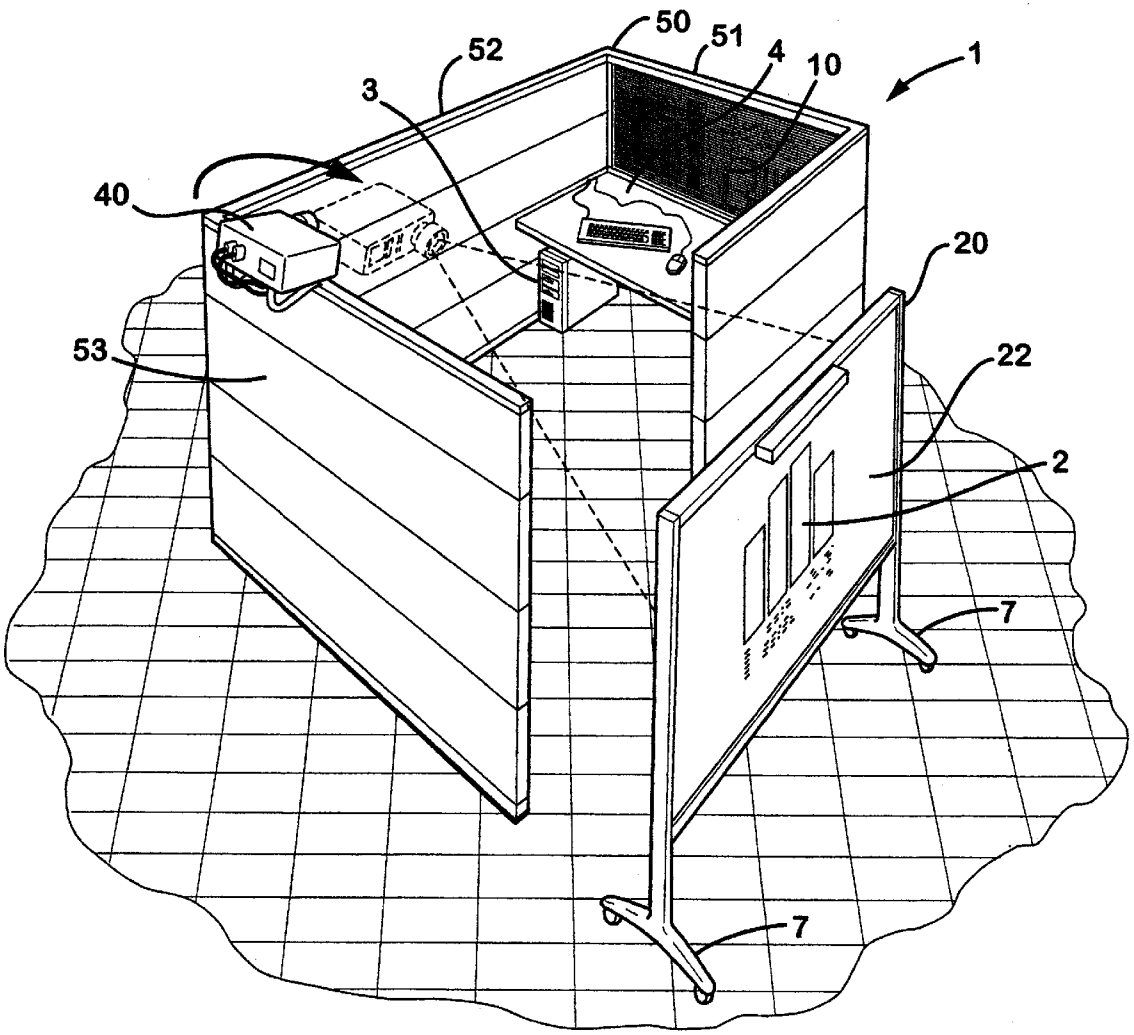
FIG. 4 is a perspective view of another embodiment of the workspace display, wherein the workspace is defined by partition panels, with a first display screen located on an interior sidewall partition, and a second display screen located near a portal opening.

With reference to FIG. 4, a two-sided second display screen 20 may be located adjacent to, and outside of a traditional "systems" type workspace 50 formed from conventional office system partition panels. The workspace 50 has a first side wall partition 51, a second side wall partition 52, and a third side wall partition 53. A workspace 4 is provided to support office work activities. As with the workspace module 30, in this configuration the two-sided second display screen 20 can be mounted with either the support brackets 7 for free-standing applications (FIG. 4), or using mounting brackets 6 for use with a prefabricated floor construction 5 (FIG. 1). The workspace illustrated in FIG. 4 has a first, one-sided display screen 10 located on the first side wall partition 51 for viewing by an individual located in the workspace 50. The display projector 40 is mounted to the third side wall partition 53, and rotates as needed to project an image onto either the first display screen 10 or the second display screen 20. The first display screen 10 has a low gloss, dry erasable markerboard surface. The second display screen 20 has an interior screen surface 21 having a low gloss, erasable markerboard surface. The second display screen 20 also has an exterior screen surface 22 having a medium gloss, dry erasable markerboard surface 22. The display projector 40 can be operatively connected to a computer 3 or other electronic device for display of images generated or transmitted thereby. The embodiment shown in FIG. 4 may use a cover 23 similar to the one illustrated in FIG. 1 for small group tasks.

Figure 6:
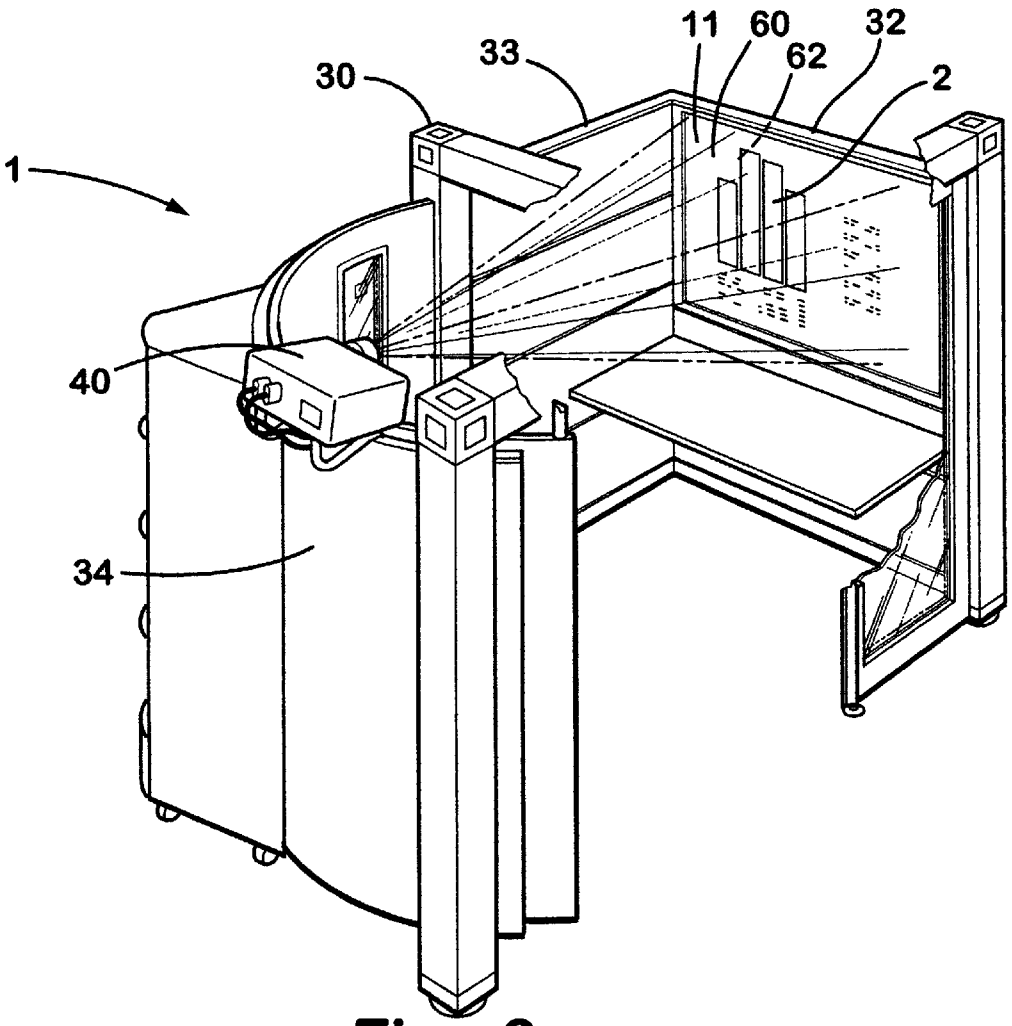
FIG. 6 is a perspective view of another embodiment of the workspace display, wherein a two-sided display screen is located in a sidewall of the workspace.
Figure 7:
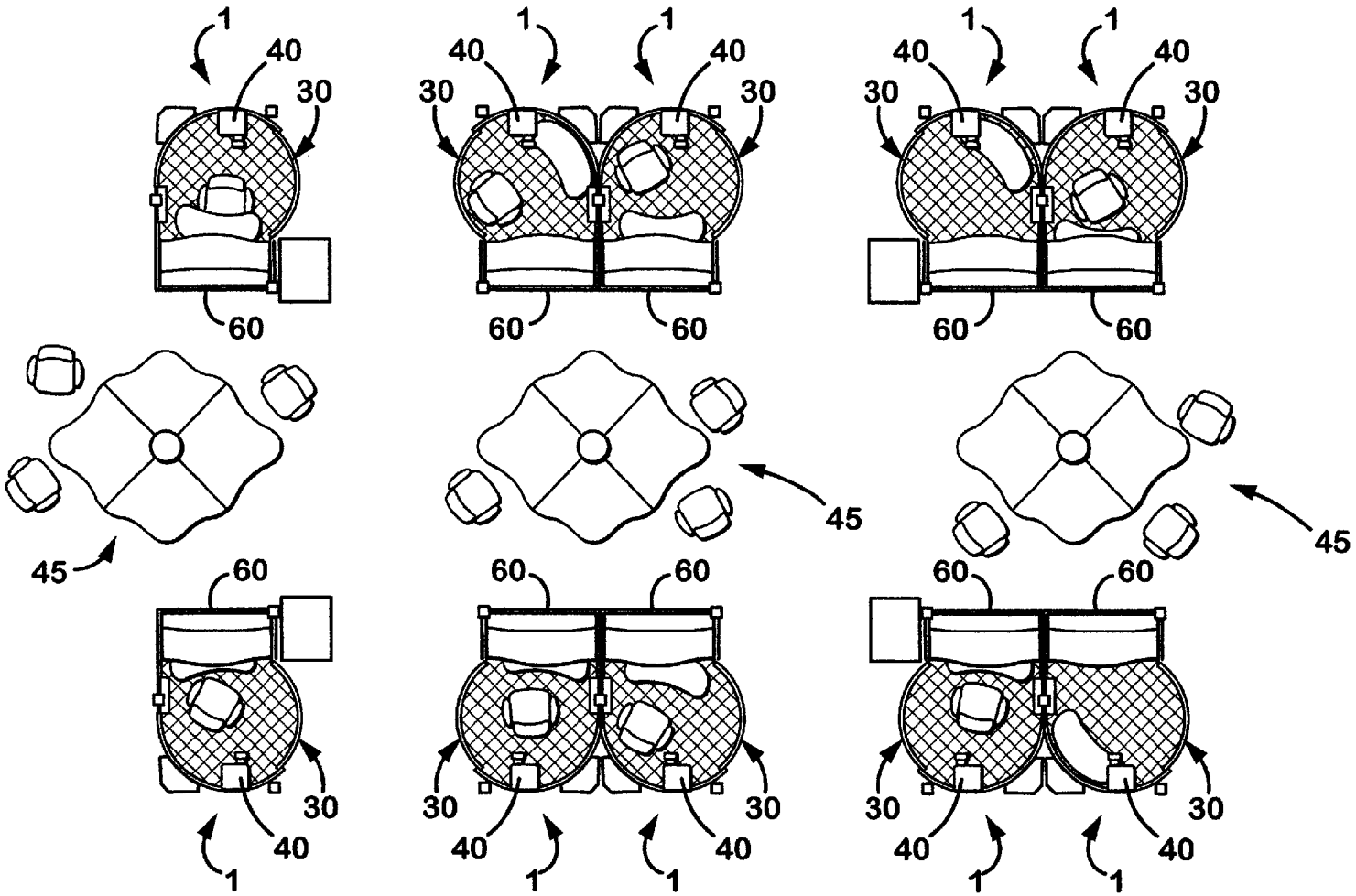
FIG. 7 is top plan view of workspaces according to FIG. 6, having two-sided display screens positioned around a common or group work area.

As illustrated in FIG. 6, a workspace module 30 having a first side wall partition 32, a second side wall partition 33, and a third side wall partition 34 may have a two-sided screen 60 located in the first side wall partition 32. The display projector 40 projects an image 2 onto the screen 60. The two-sided screen 60 has an interior surface 61, and an exterior surface 62, both of which display a projected image 2, and also have a dry erasable markerboard surfaces. As with the other embodiments, a cover 23 (not shown) may be used to prevent viewing of the image 2 from the exterior of the workspace module 30. As illustrated in FIG. 7, a workspace module 30 may be grouped with other workspace modules around a common or group work area 45 to support both group and individual work activities while maximizing the utilization of floorspace. In this configuration a user may perform individual tasks by closing the door partition 31 to view the first display screen 10, located on the interior side of the door partition 31. Alternatively, the door partition 31 may be opened, and an image 2 projected onto the interior screen surface 21 of the second display screen 20 for small-group activities. The projector 40 has image-reversing capability, thereby allowing projection onto the two-sided screen 60, creating an image that can be viewed on the exterior screen surface 62 for large-group activities.

Figure 8:
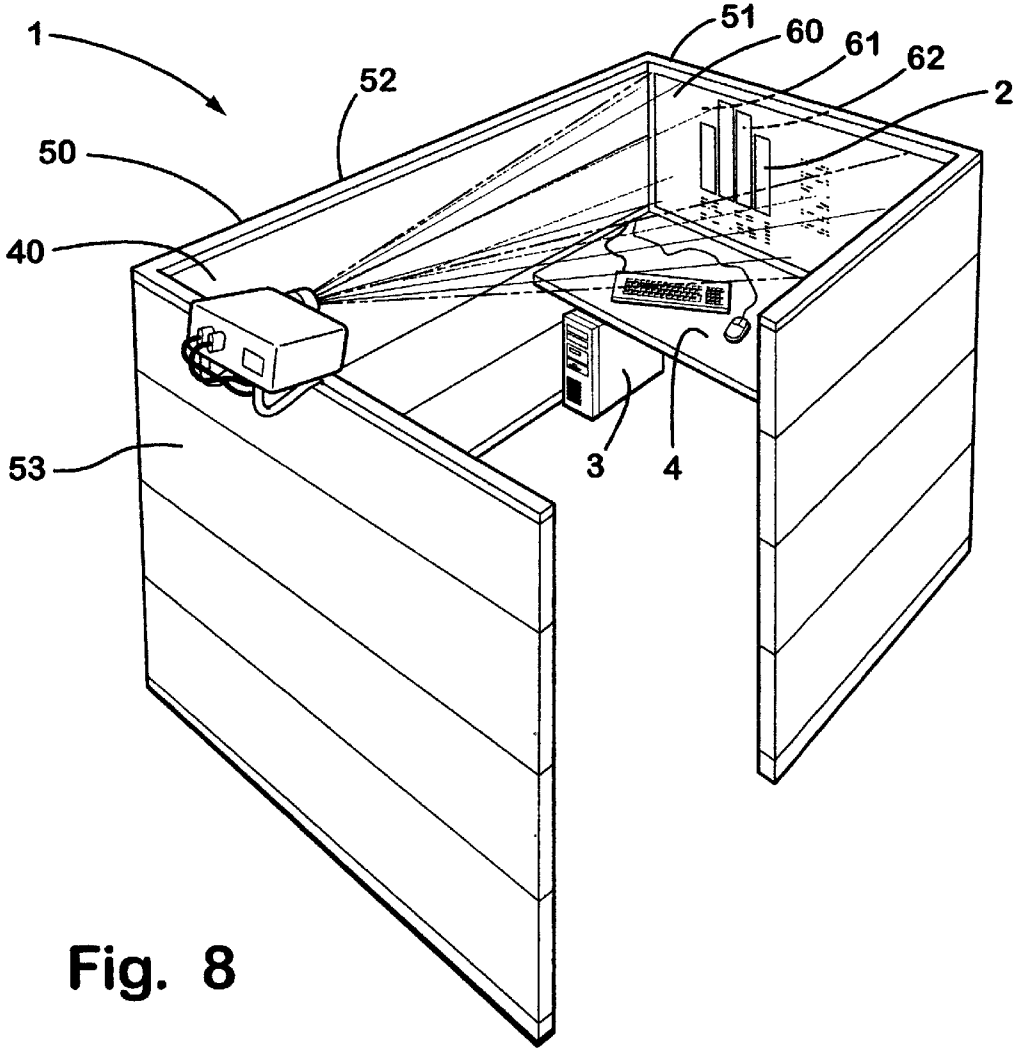
FIG. 8 is a fragmentary, perspective view of another embodiment of the workspace display having a two-sided display screen located in a sidewall partition.
Figure 9:
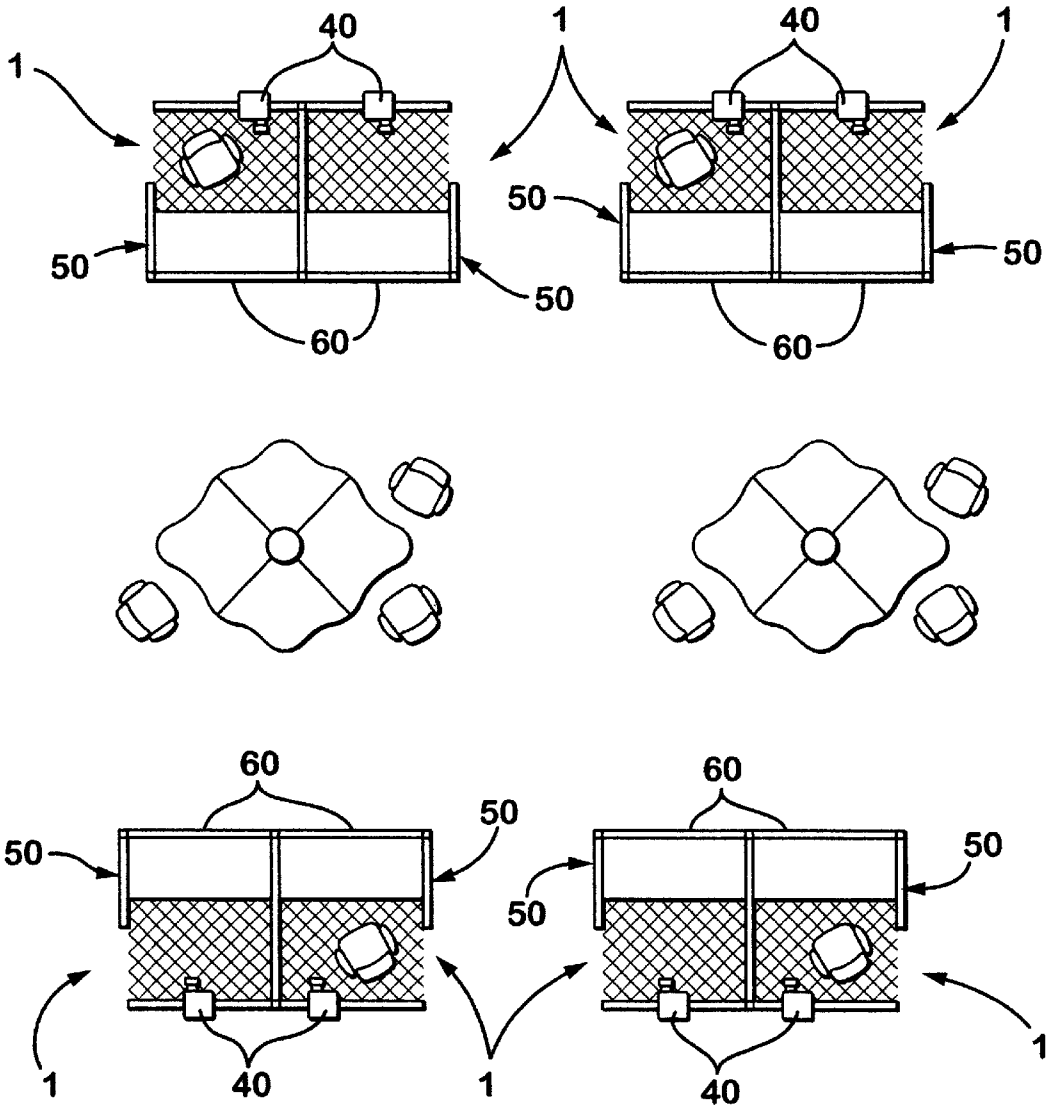
FIG. 9 is a top plan view of workspace modules according to FIG. 8 located around a common or group work area.

As illustrated in FIGS. 8 and 9, a combination two-sided display screen and markerboard may also be included in a sidewall partition of a traditional "systems" workspace 50 formed by partition panels. The workspace 50 has a first side wall partition 51, a second sidewall partition 52 and a third sidewall partition 53, each of which is formed by one or more partition panels. The first sidewall partition 51 has a rectangular display opening which supports the display screen 60. The display screen 60 closes off the first sidewall partition 51 of the workspace 50. The display projector is mounted on the third sidewall partition 53, and is configured to project an image 2 onto the interior side of two-sided screen 60, which is located in the first sidewall partition 51. The interior surface 61 has a low gloss, erasable markerboard surface for use as a markerboard, or for display of a projected image 2. Similarly, the exterior surface 62 of the two-sided screen 60 has a medium gloss, dry erasable surface for display of a projected image 2, or use as a markerboard for support of large group activities. The display projector 40 is operatively connected to a computer 3 or other electronic device for generating the projected image 2.

The workspace 50 may be clustered, as shown in FIG. 9, to support either group activities or individual tasks. The projector 40 has image-reversing capability, thereby allowing projection onto the two-sided screen 60, creating an image that can be viewed on the exterior screen surface 62 for large-group activities.

Figure 10:
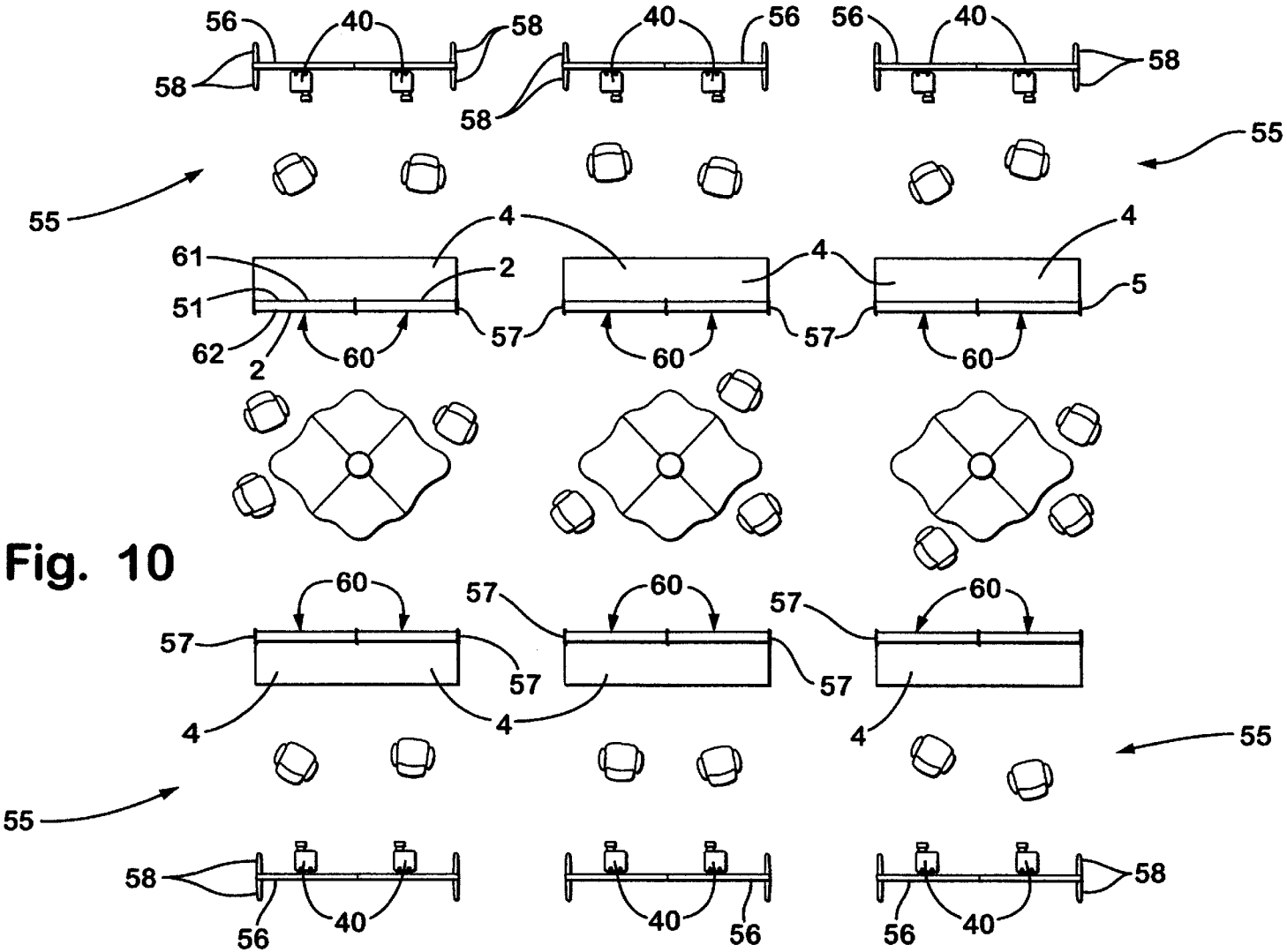
FIG. 10 is a top plan view of another embodiment of the workspace display, wherein two-sided workspaces are located around a common or group area.

As illustrated in FIG. 10, a workspace may include two sides. The two-sided workspace 55 is similar to that illustrated in FIGS. 8 and 9 except that the second sidewall partition 52 is removed. A second sidewall partition 57 is generally parallel to and located in a spaced-apart relationship relative to the first sidewall partition 56. The first sidewall partition 56 and the second sidewall partition 57 are each formed of one or more partition panels. Each second sidewall partition 57 may be supported by feet 58 as is conventional in office furniture systems. Each two-sided workspace 55 also includes a worksurface 4 which is attached to the second sidewall 57. In this embodiment, the vertical surfaces of the first and second sidewall partitions 56 and 57, respectively, which face each other, form the interior side of the sidewall partitions. The display projector is mounted on the first side 56, and is configured to project an image 2 onto the interior side of two-sided screen 60 which is located in the second side 57. The interior surface 61 has a low gloss, erasable markerboard surface for use as a markerboard, or for display of a projected image 2. Similarly, the exterior surface 62 of the two-sided screen 60 has a medium gloss, dry erasable surface for display of a projected image 2, or use as a markerboard for support of large group activities. The display projector 40 is operably connected to a computer 3 or other electronic device for generating a projected image 2.

The two-sided workspaces 55 may be clustered in groups of two, as shown in FIG. 10, to optimize space utilization while simultaneously supporting either group activities or individual tasks.

Figure 11:
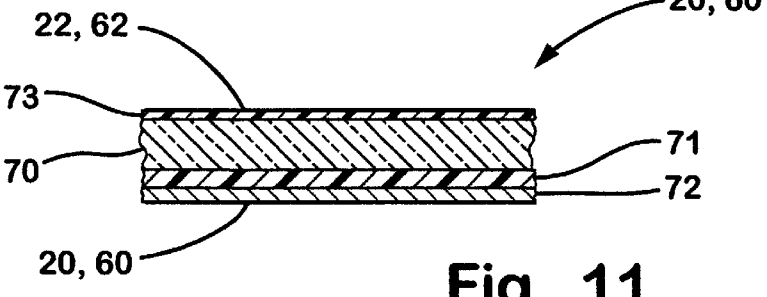
FIG. 11 is a fragmentary, cross-sectional view of a two-sided combination projection screen and markerboard embodying the present invention, comprising a transparent structural sheet, and first, second and third layers disposed on the structural sheet.

As shown in FIG. 11, a two-sided display screen 20 or 60 having a two-sided display and markerboard surface includes a transparent structural sheet 70, a substantially transparent low gloss, stain resistant, dry erasable markerboard second layer 72, a first layer 71 which simultaneously reflects and transmits incident light, while also diffusing the incident light, and a third layer 73 having a medium gloss finish that is dry erasable. These layers will typically be bonded together to maintain an appropriate viewing surface.

In a preferred embodiment, the transparent structural sheet 70 is a layer of 0.250 inch thick Acrylic polymer. The first layer 71 is a layer of white, 5 mil. VALOX FR1 film of polybutylene terephthalate material, manufactured by the General Electric Corporation. The third layer 73 is a transparent polysiloxane coating on the plexiglass, with an approximate gloss level of 50 percent. Although the thickness is not critical, in a preferred embodiment the polysiloxane coating is about 1 mil. thick. The first layer 71 simultaneously reflects approximately ½ of the incident light, while transmitting the remaining portion of the incident light through the structural sheet 70 onto the third layer 73, thereby producing an image that is visible on both the interior screen surface 21 or 61, and the exterior screen surface 22 or 62. The second layer 72 is a thin sheet of polymeric material that is hardcoated to resist staining, such as a MELINEX D725 film that is coated with MARNOT XL, manufactured by Tekra Corp., New Berlin, Wis. The second layer 72 is relatively thin to reduce the formation of a second or "ghost" image. The second layer 72 also diffuses the incident light rays to help reduce the "ghosting" effect. The third layer 73 is substantially transparent to transmit the incident light, and has a medium gloss finish which produces an image that can be viewed at a high angle relative to the screen surface 22 or 62 (FIG. 13) while also being dry erasable. Alternately, the third layer 73 could be a hardcoated polymeric film similar to the first layer 71, described above, but with a medium gloss level of about 55 percent.

Figure 13:
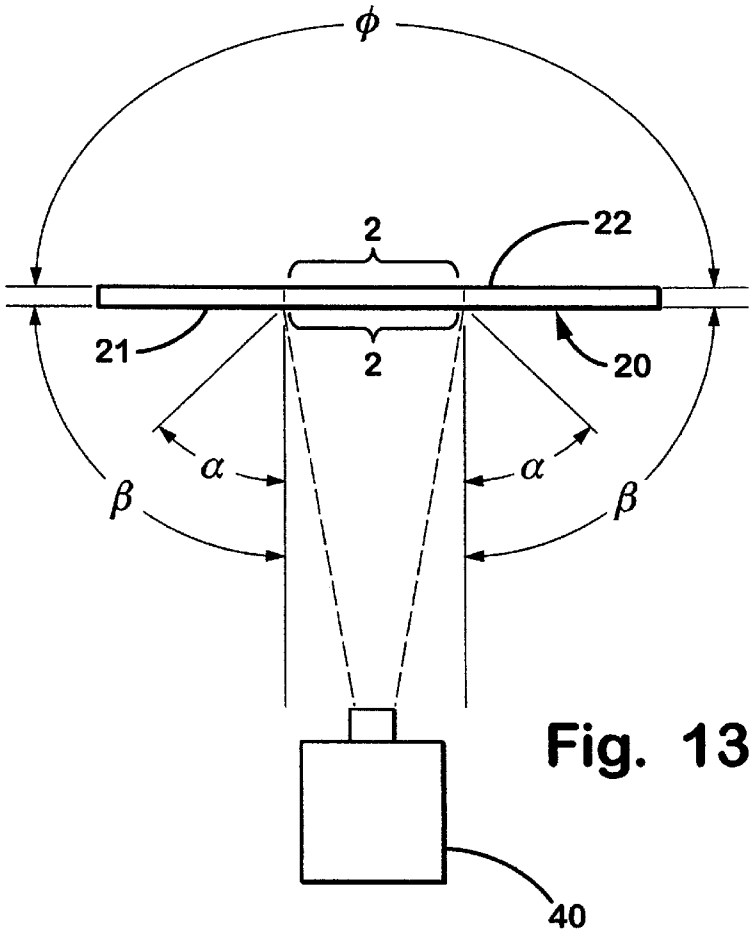
FIG. 13 is a plan view of a two-sided display screen and projector showing available viewing angles.
Figure 12:
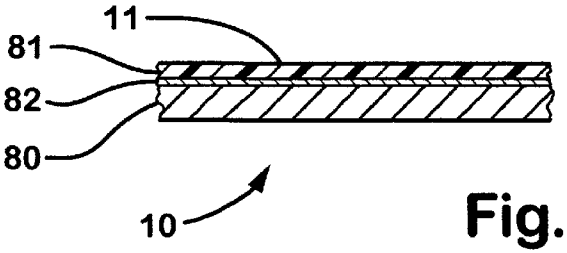
FIG. 12 is a fragmentary, cross-sectional view of a one-sided combination display screen and markerboard embodying the present invention, comprising a structural sheet and first and second layers disposed on one side of the structural sheet.

As illustrated in FIG. 12, a high gain, one-sided combination display screen and markerboard can be made by disposing a first layer 81 of a hardcoated, thin thermoplastic film, such as a Tekra MARNOT coated polymer film, having a low gloss, erasable finish onto an opaque second layer 82, which is supported on a structural sheet 80. The second layer 82 is a white, opaque layer of polymeric or other suitable material which reflects substantially all of the incident light. The first layer 81 is substantially transparent with a low gloss finish, thereby producing an image which can be viewed at a large angle relative to the screen surface 11 (FIG. 13). The structural sheet 80 may be made of any suitable material, such as wood, metal or plastic such as an acrylic polymer. Since the incident light is not transmitted through the opaque second layer 82, the optical properties of the structural sheet 80 are not critical to this construction of the one-sided combination display screen and markerboard. This construction results in a screen which has a high "gain," meaning that a relatively bright image is produced, with a lower powered projector 40. A low gloss layer of thin thermoplastic film, such as a MARNOT coated polyester film, manufactured by Tekra Corp., New Berlin, Wis., is disposed directly on the structural sheet 80.

With reference to FIG. 13, a two-sided display screen 20 according to the present invention has an image 2 that can be viewed on both the interior screen surface 21 and the exterior screen surface 22. Prior combination projection display screens and markerboards have a limited effective viewing angle $\alpha$. The projector 40 produces an image 2 on the display screen 20 that can be viewed at angles approaching 90° ($\beta$). In addition, an image 2 is produced on the exterior screen surface 22 that can be viewed from a full range, or angle $\phi$.

It will become apparent to those skilled in the art that various modifications to the preferred embodiment of the invention as described herein can be made without departing from the spirit or scope of the invention as defined by the appended claims.

What is claimed is:

1. A portable workspace display for open plan spaces and the like, comprising:

a sidewall partition configured to define a three-sided workspace having an interior side, an exterior side, a portal opening shaped to permit user ingress and egress therethrough, and a display opening disposed at a height that is viewable by an adult user;

a two-sided projection display positioned in said display opening and generally closing the same; said projection display having an interior screen facing the interior side of said sidewall partition and reflecting projected images inwardly therefrom for viewing from the interior side of said sidewall partition, and an exterior screen facing the exterior side of said sidewall partition and transmitting projected images outwardly therethrough for viewing from the exterior side of said sidewall partition;

a display projector mounted overhead adjacent said sidewall partition, and adapted to project imaged therefrom onto said interior screen to support individual activities, and to project images therefrom onto said exterior screen to support group activities, said display projector and said two-side projection display configured to simultaneously produce images on said interior screen surface and on said exterior screen surface.

2. A workspace display as set forth in claim 1, wherein:

said display projector is supported on said sidewall partition.

3. A workspace display as set forth in claim 2, wherein:

projected images are reversed by said display projector for viewing on said exterior screen.

4. A portable workspace display for open plan spaces and the like, comprising:

a rear sidewall;

a front sidewall spaced apart from said rear sidewall and configured to define a two-sided workspace having an interior and an exterior, and having a display opening disposed at a height that is viewable by an adult user;

said front and rear sidewalls configured to be supported free-standing on a floor surface and having a height that provides a gap between the sidewalls and a ceiling;

a two-sided projection display positioned in said display opening and generally closing the same; said projection display having an interior screen facing the interior side of said rear sidewall partition and reflecting projected images inwardly therefrom for viewing from the interior side of said rear sidewall partition, and an exterior screen facing the exterior side of said rear sidewall partition and transmitting projected images outwardly therethrough for viewing from the exterior side of said rear sidewall partition;

a display projector mounted overhead adjacent said workspace, and adapted to project images therefrom onto said interior screen to support individual activities, and to project images therefrom onto said exterior screen to support group activities, said display projector and said two-sided projection display configured to simultaneously produce images on said interior screen surface and on said exterior screen surface.

5. A workspace display as set forth in claim 4, wherein:

said front and rear sidewalls are parallel to one another, and including:

a third sidewall extending between said front and rear sidewalls to form a three-sided workspace.

6. A workspace display as set forth in claim 4, wherein:

said workspace includes a generally horizontal worksurface to facilitate tasks conducted by a seated user.

7. A workspace display as set forth in claim 4, wherein:

said display projector is supported on said rear sidewall partition.

8. A workspace display as set forth in claim 7, wherein:

projected images are reversed by said display projector for viewing on said exterior screen.

9. A workspace display as set forth in claim 8, further comprising:

a computer, wherein said projector is operatively connected to said computer for projecting images generated by said computer.

10. A portable workspace display for open plan spaces and the like, comprising:

a rear sidewall;

a front sidewall spaced apart from said rear sidewall and configured to define a two-sided workspace having an interior and an exterior, and having a display opening disposed at a height that is viewable by an adult user;

said front and rear sidewalls configured to be supported free-standing on a floor surface and having a height that provides a gap between the sidewalls and a ceiling;

a two-sided projection display positioned in said display opening and generally closing the same; said projection display having an interior screen facing the interior side of said rear sidewall partition and reflecting projected images inwardly therefrom for viewing from the interior side of said rear sidewall partition, and an exterior screen facing the exterior side of said rear sidewall partition and transmitting projected images outwardly therethrough for viewing from the exterior side of said rear sidewall partition;

a video device mounted overhead adjacent said workspace, and in optical communication with said interior screen, said video device and said two-sided projection display configured to simultaneously produce images on said interior screen surface and on said exterior screen surface.

11. A workspace display as set forth in claim 10, wherein:

said video device is a display projector supported directly adjacent said rear sidewall partition.

12. A workspace display as set forth in claim 11, wherein:

projected images are reversed by said display projector for viewing on said exterior screen.

13. A workspace display as set forth in claim 12, further comprising:

a computer, wherein said projector is operatively connected to said computer for projecting images generated by said computer.

14. A reconfigurable display system, comprising:

a plurality of portable workspaces, each having at least one generally vertical sidewall configured to be supported free-standing on a floor surface and having a height that provides a gap between the sidewall and a ceiling, said sidewall having an interior side and an exterior side, and having a display opening disposed at a height that is viewable by an adult user; each portable workspace including:

a two-sided display screen constructed to simultaneously reflect and transmit therethrough incident light, said two-sided display screen positioned in said display opening and generally closing the same, said two-sided display screen having interior and exterior screen surfaces;

a video device projecting light onto said interior screen surface and simultaneously generating images on said interior and exterior screen surfaces; and said workspaces positioned with said exterior sides of said vertical sidewalls facing a common area to facilitate group activities upon generation of images on at least one of said exterior screen surfaces.

15. A reconfigurable display system, comprising:

a plurality of portable workspaces, each having at least one generally vertical sidewall configured to be supported free-standing on a floor surface and having a height that provides a gap between the sidewall and a ceiling, said sidewall having an interior side and an exterior side, and having a display opening disposed at a height that is viewable by an adult user; each portable workspace including:

a two-sided display screen positioned in said display opening and generally closing the same, said two-sided display screen having interior and exterior screen surfaces;

a video device generating images on said interior and exterior screen surfaces;

said workspaces positioned with said exterior sides of said vertical sidewalls facing a common area to facilitate group activities upon generation of images on at least one of said exterior screen surfaces; and said video device and said two-sided display screen are configured to simultaneously produce images on said interior screen surface and on said exterior screen surface.

16. The display system set forth in claim 15, wherein:

said video device comprises a projector.

17. The display system set forth in claim 16, wherein:

said vertical sidewall of each portable workspace comprises a front sidewall, each portable workspace including:

a rear sidewall spaced-apart from said front sidewall, each said projector mounted on each said rear sidewall in an overhead position.

18. The display system set forth in claim 17, including:

a third sidewall extending between said front and rear sidewalls to form a three-sided workspace.

* * * * *

UNITED STATES PATENT AND TRADEMARK OFFICE

CERTIFICATE OF CORRECTION

PATENT NO. : 6,209,266 B1
DATED : April 3, 2001
INVENTOR(S) : Joseph R. Branc et al.

It is certified that error appears in the above-identified patent and that said Letters Patent is hereby corrected as shown below:

Column 10, claim 1,
Line 32, "imaged" should be -- images --.

Signed and Sealed this

Twenty-ninth Day of January, 2002

*Attest:*

*Attesting Officer*

JAMES E. ROGAN
*Director of the United States Patent and Trademark Office*